US008523607B2

(12) United States Patent
Sakurai

(10) Patent No.: US 8,523,607 B2
(45) Date of Patent: Sep. 3, 2013

(54) CABLE WITH CONNECTOR AND MANUFACTURING METHOD THEREOF

(75) Inventor: Wataru Sakurai, Kanuma (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 77 days.

(21) Appl. No.: 13/333,296

(22) Filed: Dec. 21, 2011

(65) Prior Publication Data

US 2012/0190235 A1 Jul. 26, 2012

(30) Foreign Application Priority Data

Dec. 27, 2010 (JP) ..... 2010-289419

(51) Int. Cl.
*H01R 13/66* (2006.01)

(52) U.S. Cl.
USPC ..... 439/540.1; 439/936

(58) Field of Classification Search
USPC ..... 439/540.1, 541.5, 936; 174/259
See application file for complete search history.

(56) References Cited

U.S. PATENT DOCUMENTS 3,803,531 A * 4/1974 Sorensen ..... 439/190
4,249,788 A * 2/1981 McNeel ..... 439/272
4,960,391 A * 10/1990 Beinhaur et al. ..... 439/559
6,652,292 B2 * 11/2003 Pratt et al. ..... 439/76.1
6,655,975 B1 * 12/2003 Liedtke ..... 439/276

FOREIGN PATENT DOCUMENTS

JP 2003-157926 A 5/2003
JP 2006-066352 A 3/2006

* cited by examiner

*Primary Examiner* — Khiem Nguyen
(74) *Attorney, Agent, or Firm* — Global IP Counselors, LLP

(57) ABSTRACT

[Problem] To provide a cable with a connector which can enhance simply and readily accuracy of the relative positions among plural connector units and does not cause connection failure, and a manufacturing method of the same.

[Solving Means] In a cable with a connector, a hybrid connector 1 holding a plurality of connector units 2 to 4 in a common connector housing 5 is connected to at least one end of a hybrid cable 9. The connector housing 5 has a recess groove 18 for accommodating and holding therein a flange portion 15*a* to 17*a* of the connector unit 2 to 4. The recess groove has a clearance which enables positional adjustment of the connector unit in a direction orthogonal to an axial direction of connection of the connector unit. A thermosetting adhesive 19 is applied to the clearance, whereby the plurality of connector units are bonded and fixed to the connector housing with the predetermined relative positions and intervals.

1 Claim, 3 Drawing Sheets

(A)

(B)

CABLE WITH CONNECTOR AND MANUFACTURING METHOD THEREOF

TECHNICAL FIELD

The present invention relates to a cable with a connector in which a hybrid connector which accommodates different kinds of connectors in a common connector housing is connected to a hybrid cable, and a manufacturing method of the same.

BACKGROUND ART

In consumer devices such as a personal computer and an audio-video equipment, for connection of transmission signals, various connectors are used such as a D-SUB connector, a PS/2 connector, an MDID connector, a USB connector, a DVI connector, and an HDMI connector. Further, in addition to these connectors, a power supply connector and an optical connector for optical signal are used. Since these connectors are connected to the cables in use, there are such problems as botheration in plural connector connections, and ugliness and trickiness due to congestion of the cables.

For these problems, a hybrid connector has been proposed, in which plural connectors different in type of usage are assembled and integrated in a common connector housing thereby to enable plural connector connections by one attaching/detaching operation. Examples of this hybrid connector include various types of; combination of a connector unit for power supply and a connector unit for electric signal (refer to, for example, Patent Document 1); combination of a connector unit for optical signal and a connector unit for electric signal (refer to, for example, Patent Document 2); and the like.

RELATED ART DOCUMENT

Patent Document

[Patent Document 1] JP-A-2006-66352
[Patent Document 2] JP-A-2003-157926

SUMMARY OF THE INVENTION

Problems that the Invention is to Solve

Generally, in the connection between connectors, a receptacle connector and a plug connector are connected and fitted to each other by aligning their center positions with each other. However, in case of the hybrid connector in which the plural connector units are assembled, if relative position or interval between the connector units is slightly shifted, the center positions of the receptacle-configured connector and the plug-configured connector are not coincident. Therefore, connection/fitting becomes impossible or connection is deformed in case of forcible connection and connection failure occurs.

The invention has been made in view of the above-mentioned circumstances, and an object of the invention is to provide a cable with a connector which can enhance simply and readily accuracy of the relative positions among plural connector units and does not cause connection failure, and a manufacturing method of the same.

Means for Solving the Problems

A cable with a connector according to the invention is a cable with a connector in which a hybrid connector holding a plurality of connector units in a common connector housing is connected to at least one end of a hybrid cable. The connector housing has a recess groove for accommodating and holding therein a flange portion of the connector unit. The recess groove has a clearance which enables positional adjustment of the connector unit in a direction orthogonal to an axial direction of connection of the connector unit. A thermosetting adhesive is applied to the clearance, whereby the plurality of connector units are bonded and fixed to the connector housing with the predetermined relative positions and intervals.

Further, in a manufacturing method of the cable with a connector according to the invention, a connector housing has a recess groove for accommodating and holding therein a flange portion of the connector unit, and the recess groove has a clearance which enables positional adjustment of the connector unit in a direction orthogonal to an axial direction of connection of the connector unit, and the method comprises:

accommodating the flange portion of the connector unit into the recess groove;

applying a thermosetting adhesive to the clearance;

holding the plurality of connector units by a positioning jig with predetermined relative positions and intervals; and curing the thermosetting adhesive to bond and fix the flange portion of the connector unit to the recess groove.

Advantage of the Invention

According to the invention, when the plural connector units are bonded and fixed to the connector housing, the relative positions and intervals among the connector units can be readily adjusted, whereby positional accuracy between the connectors is enhanced and therefore it is possible to realize a cable with a connector which has no connection failure.

MODE FOR CARRYING OUT THE INVENTION

Figure 1:
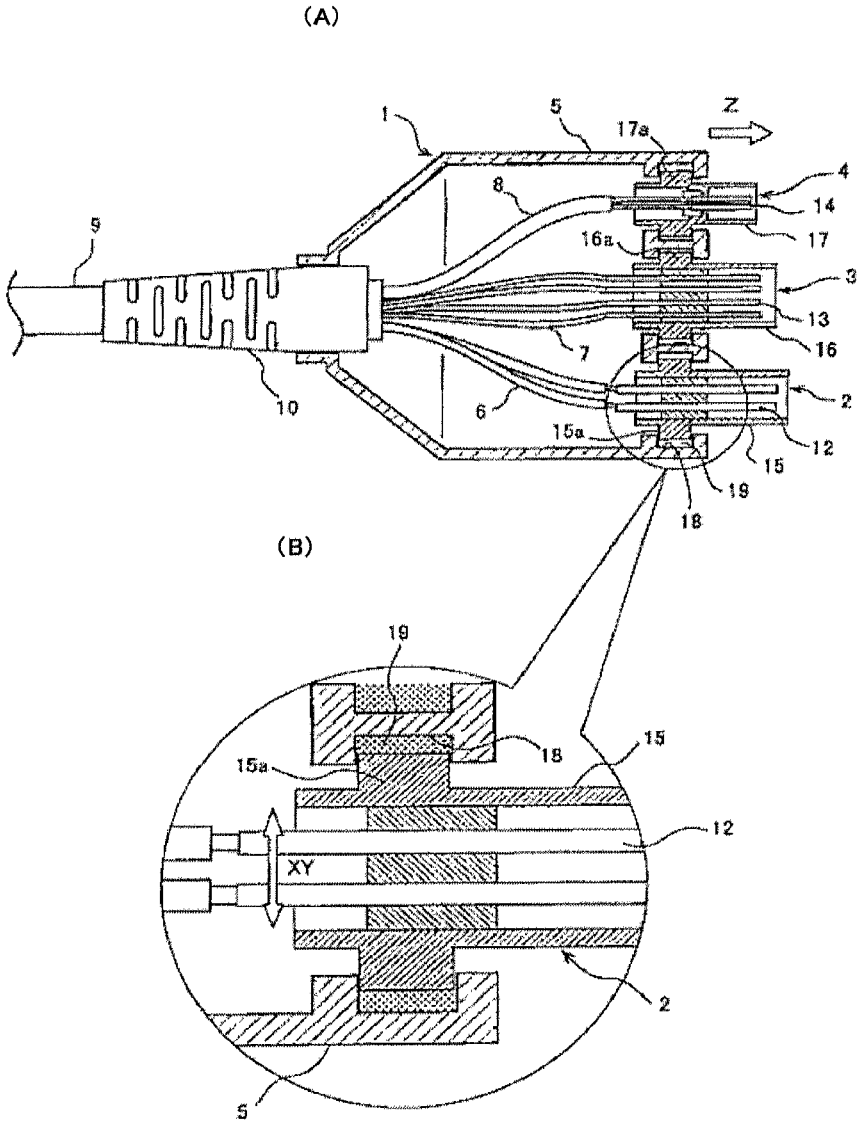
FIG. 1 It is a diagram for explaining an outline of a cable with a connector according to the invention.

With reference to drawings, an outline of the invention will be described. FIG. 1(A) shows an example of a cable with a connector according to the invention, and FIG. 1(B) is a diagram showing a main portion of the invention. In the figures, a reference numeral 1 represents a hybrid connector, 2 represents a connector unit for power supply, 3 represents a connector unit for signal, 4 represents a connector unit for optical connection, 5 represents a connector housing, 6 represents a power supply cable, 7 represents a signal cable, 8 represents an optical cable, 9 represents a hybrid cable, 10 represents a boot, 12 and 13 represent contact terminals, 14 represents an optical connector ferrule, 15 to 17 represent unit housings, 15*a* to 17*a* represent flange portions, 18 represents a recess groove, and 19 represents a thermosetting adhesive.

In the hybrid connector 1, plural connector units are accommodated and held in one common connector housing 5, and their connector units are connected like one connector. The plural connector units 2 to 4 may be different in kind or may be the same in kind. The respective electric cables 6,7 or the optical cable 8 for the plural connector units 2 to 4 are assembled to become the hybrid cable 9, and the hybrid cable 9 is connected through the boot 10 having elasticity to the hybrid connector 1.

Further, in the connection between the hybrid connectors, a plug connector and a receptacle connector are fitted to each other thereby to make connection. Although a cable with a plug connector is exemplified in FIG. 1, a cable with a receptacle connector to which the plug connector is fitted and connected may be exemplified. Further, a mode in which the hybrid cables are connected to each other may be adopted, and a connection mode of a communication device and a cable may be adopted by incorporating either hybrid connector into a housing of the device.

The hybrid connector 1, as shown in FIG. 1(A), can be constituted by accommodating and holding plural connector units such as the connector unit 2 for power supply, the connector unit 3 for signal and the connector unit 4 of optical connection into the common connector housing 5 composed of a base member and a cover member which are formed of resin. In this case, the connector unit 2 for power supply is formed by attaching a pair of male-type contact terminals 12 into the unit housing 15, and the connector unit 3 for signal is formed by attaching many male-type contact terminals 13 into the unit housing 16. Further, the connector unit 4 for optical connection is formed by attaching the optical connector ferrule 14 into the unit housing 17.

On the unit housing 15 to 17 side of each connector unit 2 to 4, the flange portion 15*a* to 17*a* is provided integrally or with an adhesive. On the connector housing 5 side, there are provided the recess grooves 18 for accommodating, holding and fixing these flange portions 15*a* to 17*a* therein. The flange portion may be formed at the end of the connector unit. The thickness of the flange portion is arbitrarily set, and in case that a step portion is formed in the connector unit, a portion of the connector unit where the diameter is large is used as the flange portion. Installment of each connector unit to the connector housing 5 is performed by accommodating the flange portions 15*a* to 17*a* of the unit housings 15 to 17 in the respective recess grooves 18 provided in the connector housing 5, applying the adhesive 19 to their accommodating portions, and bonding the flange portions 15*a* to 17*a* individually thereto.

In the invention, particularly, between the flange portion 15*a* to 17*a* of the unit housing 15 to 17 and the recess groove 18 of the connector housing 5, there is provided a clearance which enables positional adjustment of the connector unit in an orthogonal direction (XY direction) to an axial direction (for example, a direction of an arrow Z) where the connector unit 2 to 4 is connected and fitted to the counterpart connector. Further, the invention is characterized in that the thermosetting adhesive 19 is applied to this clearance. The use of a thermosetting adhesive having a viscosity of 40 mPa·s or more facilitates the application of the adhesive.

The curing temperature of the thermosetting adhesive is preferably 80 to 150° C. Examples of the housing material include polybutylene terephthalate (PBT), polyphenylene sulfide (PPS) and liquid crystal polymer (LCP), and the material which does not deform at the curing temperature of the thermosetting adhesive is selected in use.

The above-mentioned clearance is within a range where positional variations among the plural connectors due to errors and differences on the manufacture are covered, and preferably about 0.1 mm to 1.0 mm in size. Until the thermosetting adhesive 19 is heated and cured, the connector units 2 to 4 are installed in the connector housing 5, and the relative positions and intervals among the plural connector units can be readily adjusted, in a state where the thermosetting adhesive 19 is applied, by means of a jig.

On the other hand, in case that the plural connector units have been fixed to the connector housing, differences in positional interval can be produced among the plural connector units due to errors on the manufacture of the connector units and recess grooves of the connector housing. In such the case, the connector unit which is difficult in connection is produced. In case that this connector unit is forcedly connected, the contact terminals and the connector unit deform, so that connection failure occurs.

Further, in the hybrid connector which assembles therein the plural connector units, in order to lower the insertion force in the connection starting time, connection timing of the plural connector units are frequently made different. Also in this example, the hybrid connector may be formed so that timing of connection to the counterpart receptacle connector is different among the connector units by making the protruding lengths of the plural connector units different.

Further, also the receptacle-sided hybrid connector, similarly to the plug-sided hybrid connector, can be constituted so that the position of each connector unit is adjustable by providing a clearance for a bonding/fixing portion of the connector unit.

Figure 2:
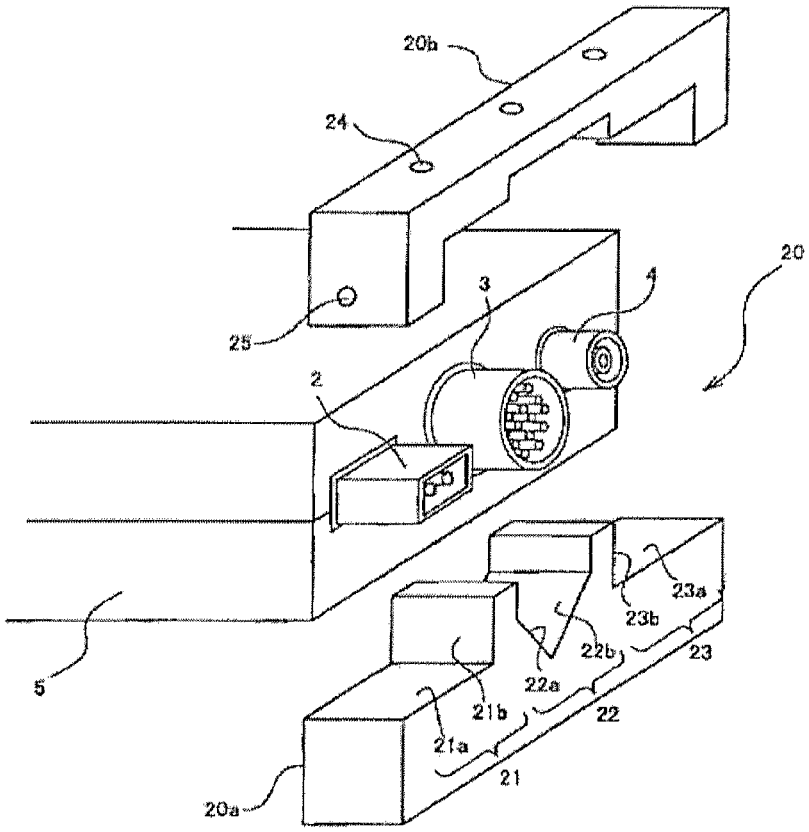
FIG. 2 It is a diagram for explaining an example of a jig which sets positional intervals among plural connector units in the invention.
Figure 3:
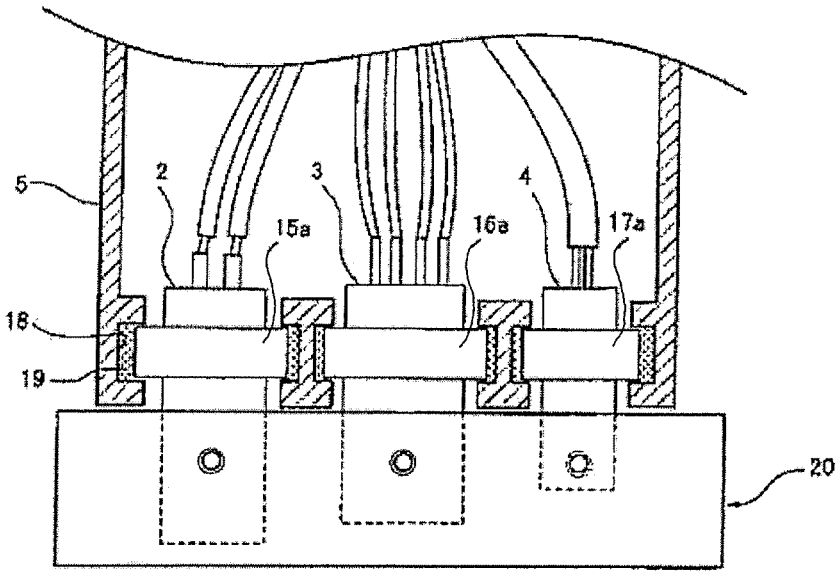
FIG. 3 It is a diagram for explaining an alignment state by the jig of FIG. 2.
Figure 3:
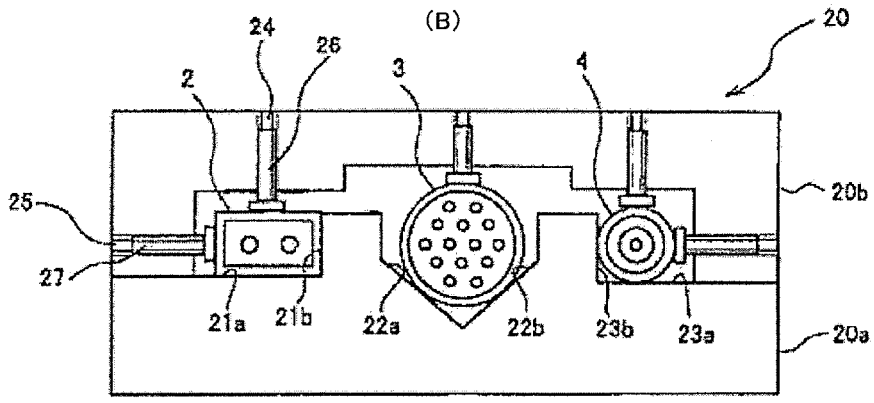

FIGS. 2 and 3 show an example of a method for adjusting the positional intervals among the plural connector units and positioning the connector units, in which a positioning jig 20 can be used.

As shown in FIG. 2, the positioning jig 20 is formed by, for example, a metallic jig base 20*a* and a press base 20*b*. The positioning jig 20 is installed so as to sandwich fitting portions of the plural connector units 2 to 4 protruding from a front surface of the connector housing 5 between the jig base 20*a* and the press base 20*b* from the up-down direction.

In the jig base 20*a*, positioning wall surfaces 21, 22 and 23 are formed, to which the fitting portions of the plural connector units are pressed so as to come into contact therewith in order to be positioned. This positioning wall surface 21 to 23 is formed in response to the shape of the connector unit, and includes at least two surfaces which determine the up-down position and the lateral position of the connector unit. For example, for the rectangular connector unit 2, the positioning wall surface 21 includes two surfaces of: a horizontal wall surface 21*a* which sets the up-down position of the connector unit 2; and a vertical wall surface 21*b* which sets the lateral position of the connector unit 2. Further, for the center connector unit 3 having the circular external shape, the positioning wall surface 22 can include two wall surfaces 22*a* and 22*b* which form the V-shape. For the connector unit 4 having similarly the circular external shape, the positioning wall surface 23 can include two surfaces of: a horizontal wall surface 23*a* which sets the up-down position of the connector unit 4; and a vertical wall surface 23*b* which sets the lateral position of the connector unit 4.

The press base 20*b* is placed on the jig base 20*a*, and connected to and held by the jig base 20*a* with the plural connector units between the press base 20*b* and the jig base 20*a*. On a top surface side of the press base 20*b*, screw holes 24 for installing shaft members 26 (refer to FIG. 3) which press the connector units to the jig base 20*a* side are provided in response to the center position of each connector unit. Further, also both end sides of the press base 20*b*, there are provided screw holes 25 for installing shaft members 27 (refer to FIG. 3) which press the connector units in the lateral direction.

FIG. 3 is a diagram showing a state where the relative positions and intervals among the plural connector units 2 to 4 are determined by the above positioning jig 20. The connector unit 2 is pressed onto the horizontal wall surface 21*a* of the jig base 20*a* by the shaft member 26 from above on the press base 20*b* side, and pressed onto the vertical wall surface 21*b* by the shaft member 27 from the lateral direction, thereby to be positioned. The center connector unit 3 is pressed onto the V-shaped wall surface 22*a*, 22*b* of the jig base 20*a* by the shaft member 26 from above on the press base 20*b* side, whereby positioning in the up-down direction and positioning in the lateral direction are simultaneously performed. Further, the connector unit 4, similarly to the connector unit 2, is pressed onto the horizontal wall surface 23*a* and the vertical wall surface 23*b* by the shaft member 26 from above on the press base 20*b* side and by the shaft member 27 from the lateral direction, thereby to be positioned.

In case that the plural connector units are positioned and fixed, it is good in balance to firstly position the center connector unit which becomes most the criterion and to next position the connector unit located on the outside. In the example shown in FIG. 3, it is preferable that the connector unit 3 is positioned by the V-shaped wall surface 22*a*, 22*b*, and thereafter the connector unit 2 or the connector unit 4 on the outside is positioned and fixed.

After the plural connector units 2 to 4 have been positioned by the positioning jig 20, the connector housing 5 is heated under this positioning state, and the thermosetting adhesives 19 applied to the clearance portions in the recess grooves 18 are cured while holding the connector units, whereby the connector units are bonded and fixed to the recess grooves 18. In result, the relative positions and intervals among the plural connector units 2 to 4 are accurately set to the predetermined values, and it is possible to prevent the connection failure of the hybrid connector from being produced.

DESCRIPTION OF REFERENCE NUMERALS AND SIGNS

1 Hybrid connector, 2 Connector unit for power supply, 3 Connector unit for signal, 4 Connector unit for optical connection, 5 Connector housing, 6 Power supply cable, 7 Signal cable, 8 Optical cable, 9 Hybrid cable, 10 Boot, 12, 13 Contact terminal, 14 Optical connector ferrule, 15 to 17 Unit housing, 15*a* to 17*a* Flange portion, 18 Recess groove, 19 Thermosetting adhesive, 20 Positioning jig, 20*a* Jig base, 20*b* Press base, 21 to 22 Positioning wall surface, 24,25 Screw hole, 26, 27 Shaft member

The invention claimed is:

1. A cable with a connector in which a hybrid connector holding a plurality of connector units in a common connector housing is connected to at least one end of a hybrid cable, wherein:

the connector housing has a recess groove for accommodating and holding therein a flange portion of the connector unit;

the recess groove has a clearance which enables positional adjustment of the connector unit in a direction orthogonal to an axial direction of connection of the connector unit; and a thermosetting adhesive is applied to the clearance, whereby the plurality of connector units are bonded and fixed to the connector housing with the predetermined relative positions and intervals.

* * * * *